US010879018B2

(12) United States Patent
Göransson et al.

(10) Patent No.: US 10,879,018 B2
(45) Date of Patent: Dec. 29, 2020

(54) SUPPLEMENTARY ISOLATING DEVICE FOR REMOTE OPERATION OF A CIRCUIT BREAKER FOR ELECTRICAL EQUIPMENT

(71) Applicant: ABB Schweiz AG, Baden (CH)

(72) Inventors: Bertil Göransson, Västerås (SE); Anders Hansson, Västerås (SE)

(73) Assignee: ABB Schweiz AG, Baden (CH)

( * ) Notice: Subject to any disclaimer, the term of this patent is extended or adjusted under 35 U.S.C. 154(b) by 154 days.

(21) Appl. No.: 16/316,238

(22) PCT Filed: May 31, 2017

(86) PCT No.: PCT/EP2017/063083
§ 371 (c)(1),
(2) Date: Jan. 8, 2019

(87) PCT Pub. No.: WO2018/007070
PCT Pub. Date: Jan. 11, 2018

(65) Prior Publication Data

US 2020/0227215 A1 Jul. 16, 2020

(30) Foreign Application Priority Data

Jul. 8, 2016 (EP) ..... 16178544

(51) Int. Cl.

| | |
|---|---|
| ***H01H 9/26*** | (2006.01) |
| ***H01H 9/28*** | (2006.01) |
| ***H01H 71/04*** | (2006.01) |
| ***H01H 71/08*** | (2006.01) |
| ***H01H 71/10*** | (2006.01) |
| ***H01H 83/12*** | (2006.01) |

(52) U.S. Cl.
CPC ..... *H01H 9/26* (2013.01); *H01H 9/281* (2013.01); *H01H 71/04* (2013.01); *H01H 71/08* (2013.01);
(Continued)

(58) Field of Classification Search
CPC ..... H01H 9/26; H01H 9/281; H01H 71/04; H01H 71/08; H01H 71/10; H01H 83/12;
(Continued)

(56) References Cited

U.S. PATENT DOCUMENTS 4,623,859 A * 11/1986 Erickson ..... H01H 3/38 335/14
8,896,162 B1 11/2014 Ledbetter
(Continued)

FOREIGN PATENT DOCUMENTS

DE 102013112570 A1 5/2015

OTHER PUBLICATIONS

DE 102013112570, Eaton Electrical, May 21, 2015 (Year: 2015).*
(Continued)

*Primary Examiner* — Dharti H Patel
(74) *Attorney, Agent, or Firm* — Whitmyer IP Group LLC

(57) ABSTRACT

The present disclosure relates to a supplementary isolating device for remote operation of a circuit breaker with interlocking functionality. The supplementary isolating device includes: an electrical disconnection switch manoeuvrable between a mechanically lockable first position and a mechanically lockable second position, which electrical disconnection switch is configured to be connected in the control circuit of a circuit breaker for an electrical drive system, wherein the supplementary isolating device is configured to send a first control voltage to the circuit breaker to provide an electrical disconnect and interlocking the operation of the circuit breaker, when the electrical disconnection switch is in the first position, an electric terminal configured to be connected to an auxiliary contact of the circuit breaker to obtain an operational status of the circuit breaker, and an indicator configured to indicate the operational status of the circuit breaker.

18 Claims, 2 Drawing Sheets

(52) U.S. Cl.
CPC ..... *H01H 71/10* (2013.01); *H01H 83/12* (2013.01); *H01H 2071/086* (2013.01)

(58) Field of Classification Search
CPC ..... H01H 2071/086; H01H 7/00; H01H 9/16; H01H 3/02
USPC ..... 361/139
See application file for complete search history.

(56) References Cited

U.S. PATENT DOCUMENTS

| | | | | |
|---|---|---|---|---|
| 2009/0322083 | A1 | 12/2009 | Wagoner et al. | |
| 2011/0163837 | A1* | 7/2011 | Darr | H01H 71/123 337/186 |
| 2014/0376142 | A1* | 12/2014 | Luebke | H01H 85/48 361/104 |
| 2016/0131712 | A1* | 5/2016 | Bock | H01H 47/02 324/537 |

OTHER PUBLICATIONS

European Search Report Application No. 16178544.9 dated Oct. 19, 2016 7 Pages.
International Preliminary Report on Patentability Application No. PCT/EP2017/063083 dated Jun. 7, 2018 13 Pages.
Indian Office Action; Application No. 201947004479; dated Oct. 22, 2020; 5 pages.

* cited by examiner

SUPPLEMENTARY ISOLATING DEVICE FOR REMOTE OPERATION OF A CIRCUIT BREAKER FOR ELECTRICAL EQUIPMENT

TECHNICAL FIELD

The present disclosure generally relates to an isolating device for lockout-tagout operation of electrical equipment.

BACKGROUND

In the industry today the disconnecting, i.e. isolation, of electrical supply equipment prior to major maintenance is normally performed directly, i.e. physically on the supply equipment itself.

Such equipment is usually located in a locked electrical room where a specified lockout-tagout procedure (LOTO) for isolation, i.e. electrical disconnect, has to be performed. Often specialized personnel have to be sent for to perform this procedure.

Today, the power circuits to relatively small electric motors can conveniently be disconnected by switch-disconnectors located next to the motors and their machinery objects. But, above a certain power such switch-disconnecting equipment becomes both expensive and will take up a lot of space and is therefore no option. Hence, the electrical room or area remains today the only location to disconnect the power for mid-size and large motors.

US 2009/0322083 discloses an integrated fault and personnel protection system for a multi-thread converter in a wind turbine power system. An aim of this document is to provide personnel protection during fault conditions and during maintenance. Sensors and disconnects for the protections are positioned close to the source of energy to protect more of the system. Components are moved into separate physical structures, e.g. cabinets, to enhance protection. At least one motor-operated breaker may be positioned between the converter and the generator. The motor-operated circuit breakers may also be tripped by a remote switch located in the tower lower level to provide for lockout-tagout protection.

SUMMARY

The motor-operated circuit breakers disclosed in US 2009/0322083, are connected between the converter and the generator and is specifically a generator type of configuration. The remote switch operates a circuit breaker at tower lower level. Furthermore, the remote switch trips the motor-operated circuit breaker directly on the undervoltage coil. This indicates a solution where tripping is made under load.

In view of the above, an object of the present disclosure is to provide an isolating device for operating a circuit breaker, which solves or at least mitigates problems of the prior art.

There is hence according to a first aspect of the present disclosure provided a supplementary isolating device for remote operation of a circuit breaker with interlocking functionality, wherein the supplementary isolating device comprises: an electrical disconnection switch manoeuvrable between a mechanically lockable first position and a mechanically lockable second position, which electrical disconnection switch is configured to be connected in the control circuit for a circuit breaker of an electrical drive system, wherein the supplementary isolating device is configured to send a first control voltage to the circuit breaker to provide an electrical disconnect and interlocking the operation of the circuit breaker, when the electrical disconnection switch is in the first position, an electric terminal configured to be connected to an auxiliary contact of the circuit breaker to obtain an operational status of the circuit breaker, and an indicator configured to indicate the operational status of the circuit breaker.

The supplementary isolating device is essentially a duplication of the local isolating function of the circuit breaker, located in an electrical room or area. The location of the supplementary isolating device can be flexibly chosen as it is designed for easily installed control cabling, but the device is intended to be installed at a site remote from the electrical room or area, advantageously close to motor or machinery. This enables simple access for an operator to perform a LOTO operation conveniently in the vicinity of the machinery, i.e. remotely from the electrical room or area with the electrical supply equipment which may be located hundreds of metres from machinery and may require passing an environment that is difficult to and/or time consuming to manoeuvre through.

Moreover, to operate the supplementary isolating device it is not necessary to call in an electrician for the LOTO because only control voltage levels, and no power feed levels are involved in the operation of the supplementary isolating device. Since no power feed levels are involved, the size of the supplementary isolating device may be kept small, especially since no large power cables have to be led into the housing of the supplementary isolating device. The supplementary isolating device may therefore conveniently be installed at essentially any suitable location advantageously chosen near a motor or machinery.

Furthermore, the electrical disconnection switch is lockable in two positions, thus ensuring that it is only operated when sending control voltages to the circuit breaker for operation thereof. Hereto, it may be ensured that the electrical disconnection switch can be locked in the first position, i.e. in a position which provides an electrical disconnect of the circuit breaker, allowing the operator to confidently work on the machine, including the electrical equipment.

Auxiliary contacts of a circuit breaker are configured to provide a signal regarding the operational status of the circuit breaker. The indicator and the electric terminal, which is connectable to the auxiliary contact of the circuit breaker, ensures that personnel handling the supplementary isolating device is always informed of the current operational status of the circuit breaker.

According to one embodiment the supplementary isolating device is configured to send a second control voltage to the circuit breaker to close the circuit breaker when the electrical disconnection switch is in the second position.

According to one embodiment, the electrical disconnection switch is configured to be locked in the first position and in the second position by means of a padlock. It may thereby be ensured that no electrical disconnect can be performed unless the padlock is removed when the electrical disconnection switch is arranged in the second position.

According to one embodiment, the indicator is a visual indicator. This essentially fulfils a requirement set forth in standard IEC 60204-1, and ensures that an operator is able to identify whether there is an electrical disconnect present or not.

One embodiment comprises a first switch terminal configured to be connected to an opening coil and to an undervoltage coil of the control circuit for providing the first control voltage, and a second switch terminal configured to be connected to a closing coil of the control circuit for providing the second control voltage. By sending a control voltage to the undervoltage coil of the circuit breaker, interlocking of the operation of the circuit breaker in an open state thereof may be obtained.

One embodiment comprises a first low voltage electric wire and a second low voltage electric wire each having a length in the order of a plurality of metres, the first electric wire, and the second electric wire being configured to be connected between the electrical disconnection switch and the control circuit of the circuit breaker to send the first control voltage and the second control voltage, respectively, from the supplementary isolating device to the control circuit.

According to one embodiment, each of the first low voltage electric wire and the second low voltage wire has a length in the order of a plurality of metres.

One embodiment comprises a signal cable having a length in the order of a plurality of metres, the signal cable being configured to be connected between the electric terminal and the auxiliary contact to obtain the operational status of the circuit breaker.

There is according to a second aspect of the present disclosure provided an electrical system for a motor, comprising: an electrical drive system configured to drive the motor, a circuit breaker with interlocking functionality, wherein the circuit breaker is configured to disconnect the electrical drive system from a power source configured to power the electrical drive system, and a supplementary isolating device according to the first aspect disclosed herein, configured to operate the circuit breaker from a remote location relative to the circuit breaker and the electrical drive system.

According to one embodiment, the circuit breaker comprises a first button, a second button, an opening coil, an undervoltage coil, and a closing coil, wherein the first button is configured to operate only the opening coil and the second button is configured to operate only the closing coil.

According to one embodiment, the opening coil is configured to be operated with the first control voltage from the supplementary isolating device to provide an electrical disconnect of the circuit breaker, the closing coil being configured to be operated with the second control voltage from the supplementary isolating device to provide a closing of the circuit breaker, wherein the undervoltage coil is configured to be operated by the first control voltage to disconnect the opening coil from the first button and to disconnect the closing coil from the second button and to be operated by the second control voltage to connect the closing coil to the first button and the opening coil to the second button.

One embodiment comprises a time delay device configured to be connected to the control circuit of the circuit breaker, and configured to be connected to the supplementary isolating device for receiving the first control voltage and the second control voltage and to operate the opening coil and the undervoltage coil, and the closing coil, of the control circuit in accordance with the first control voltage and the second control voltage.

According to one embodiment, the time delay device has a delay functionality configured to provide a delay from receiving the first control voltage to operating the opening coil, wherein the time delay device is configured to operate the undervoltage coil after operating the opening coil.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
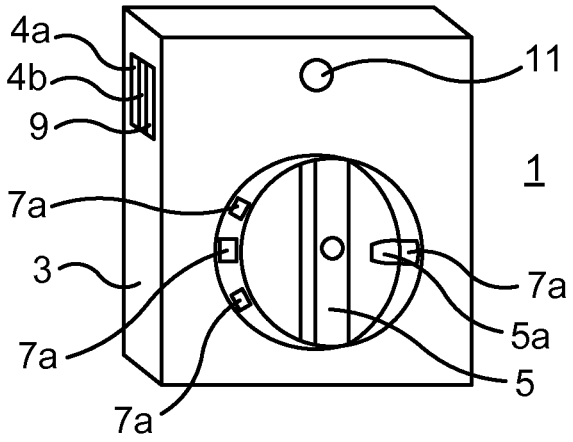
FIG. 1 schematically shows an example of a supplementary isolating device.

FIG. 1 shows an example of a supplementary isolating device 1. With the term "supplementary" is here meant that it supplements, or is secondary to, a local isolating function already present in a circuit breaker, for locally operating the circuit breaker, specifically a circuit breaker with interlocking functionality. With "interlocking functionality" is meant a certain type of circuit breaker which has an inherent property of interlocking the circuit breaker in a state of electrical disconnect, as will be described in more detail in the following.

The supplementary isolating device 1 is configured to be remotely connected to and remotely operate a circuit breaker of an electrical drive system, by means of control voltages, which circuit breaker is provided with interlocking functionality. The supplementary isolating device 1 is thus adapted and configured to be installed at a remote site relative to the circuit breaker.

In the context of the present disclosure, the circuit breaker is generally provided in an electrical room or area comprising one or more electrical cabinets including equipment such as an electrical drive system for driving motors of machinery of for example a process industry such as a pulp and paper mill or a steel mill. The supplementary isolating device 1 may advantageously be installed at a convenient location, in the proximity of the machinery, e.g. a paper machine, pulp refiners, stainless steel grinding lines, and so on, driven by motors to allow easy access to a LOTO operation for the operator or other maintenance personnel. The supplementary isolating device 1 may for example be installed next to a specific motor that is to be isolated, in order to reduce the risk of confusion as to what machinery is isolated by the supplementary isolating device 1.

The exemplified supplementary isolating device 1 comprises an enclosure or housing 3 and an electrical disconnection switch 5 which is accessible externally relative to the housing 3. The electrical disconnection switch 5 is manoeuvrable between a first position and a second position. The electrical disconnection switch 5 is furthermore mechanically lockable in the first position and in the second position. Thus, when the electrical disconnection switch 5 is locked in the first position, it is not possible to manoeuvre the electrical disconnection switch 5 to the second position. The same applies when the electrical disconnection switch 5 is locked in the second position, i.e. it is in this case not possible to manoeuvre the electrical disconnection switch 5 to the first position.

According to the example shown in FIG. 1, the electrical disconnection switch 5 is rotatable between the first position and the second position. The exemplified electrical disconnection switch 5 has a cut-out or through-opening 5*a*, and the supplementary isolating device 1 has a circular collar 7 arranged around the electrical disconnection switch 5. The collar 7 is provided with a plurality of through-openings 7*a*, which when aligned with the cut-out 5*a* allows for mounting of the shackle of a padlock to thereby ensure mechanical locking of the electrical disconnection switch 5. One through-opening 7*a* of the collar 7 and the cut-out 5*a* are so arranged that they become aligned when the electrical disconnection switch 5 is in the first position and another through-opening 7*a* of the collar 7 is so arranged that it becomes aligned with the cut-out 5*a* when the electrical disconnection switch 5 is in the second position. It is to be noted that other physical configurations of the electrical disconnection switch and the mechanical locking thereof are also possible, as would be apparent to the person skilled in the art.

The electrical disconnection switch 5 is configured to be connected to the control circuit of a circuit breaker having interlocking functionality. The electrical disconnection switch 5 may either be connected directly to the control circuit, or indirectly via a time delay device, as will be elaborated upon in the following.

When the electrical disconnection switch 5 is in the first position, the supplementary isolating device 1 is configured to send a first control voltage to the circuit breaker to provide an electrical disconnect and interlocking the operation of the circuit breaker. When the electrical disconnection switch 5 is in the second position, the supplementary isolating device 1 is configured to send a second control voltage to the circuit breaker to close the circuit breaker.

The supplementary isolating device 1 also includes an electrical terminal 9 configured to be connected to an auxiliary contact of a circuit breaker to obtain an operational status of the circuit breaker, and an indicator 11 operatively connected to the electrical terminal 9, and configured to indicate the operational status of the circuit breaker as received by the electrical terminal 9. In particular, the auxiliary contact provides an acknowledgement to the supplementary isolating device 1 regarding a status change of the circuit breaker obtained by manoeuvring the electrical disconnection switch 5. The indicator 11 is preferably a visual indicator. The indicator 11 may for example be a lamp or a light emitting diode (LED).

Figure 2:
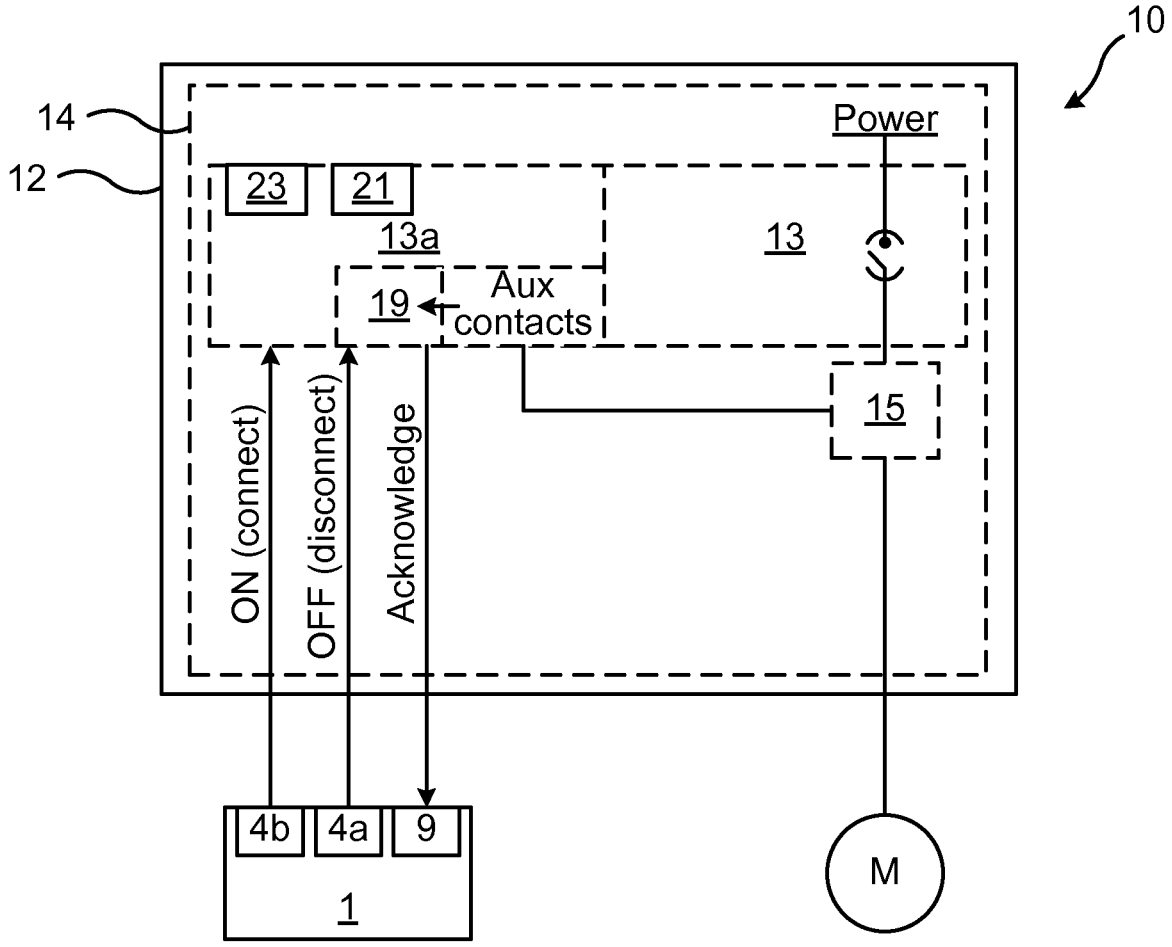
FIG. 2 schematically shows a diagram of an electrical system comprising the isolating device in FIG. 1.

Turning now to FIG. 2 an example of an electrical system 10 for a motor is shown. The electrical system 10 comprises the supplementary isolating device 1, a circuit breaker 13 having a control circuit 13*a* and a local isolating function including a first button 21 and a second button 23, an electrical drive system 15, configured to be connected to the control circuit of the circuit breaker 13.

In FIG. 2, an electrical room or area 12 is symbolically shown by the rectangle that encloses the circuit breaker 13 and the electrical drive system 15. The dashed line enclosed by the electrical room 12 symbolises one or more electrical cabinet(s) 14 located in the electrical room 12 and which contain(s) the circuit breaker 13 and the electrical drive system 15. The electrical drive system 15 is configured to be connected to a motor M located outside the electrical room or area 12, which in turn powers machinery, for example process industry machinery.

The supplementary isolating device 1 has a first switch terminal 4*a* and a second switch terminal 4*b*, as also shown in FIG. 1. These are configured to be connected to the control circuit 13*a* of the circuit breaker 13. The first switch terminal 4*a* is configured to provide the first control voltage to the control circuit 13*a* and the second switch terminal 4*b* is configured to provide the second control voltage to the control circuit 13*a*. As previously mentioned, the first control voltage is configured to provide an electrical disconnect, or set the circuit breaker 13 in an open state. The first control voltage is furthermore configured to provide an interlocking of the circuit breaker 13. Hereto, the first switch terminal 4*a* is configured to be connected to an opening coil and to an undervoltage coil of the circuit breaker 13, in particular of the control circuit 13*a* thereof. The second control voltage is configured to set the circuit breaker 13 in a closed state. The second switch terminal 4*b* is thus configured to be connected to a closing coil of the circuit breaker 13, in particular of the control circuit 13*a* thereof.

The first switch terminal 4*a* may be connected to the control circuit 13*a* by means of a first electric wire which preferably has a length of a plurality of metres, typically several tens of metres or even hundreds of metres. The second switch terminal 4*b* may be connected to the control circuit 13*a* by means of a second electric wire which preferably has a length of a plurality of metres, typically several tens of metres or even hundreds of metres. Hereto, the supplementary isolating device 1 may be installed remotely from the electrical room 12, preferably in the proximity of the motor M which it is configured to disconnect/isolate, as symbolically illustrated in FIG. 2. Furthermore, a signal cable having a length in the order of a plurality of metres, typically several tens of metres or hundreds of metres, may be connected between the electrical terminal 9 and the auxiliary contact to obtain the operational status of the circuit breaker 13.

The first button 21 of the circuit breaker 13 is configured to operate the opening coil to provide an electrical disconnect of the circuit breaker 13, i.e. to set the circuit breaker in its open state, and a second button 23 configured to operate the closing coil, i.e. to set the circuit breaker in its closed state. The first button 21 and the second button 23 are not connected or connectable to the undervoltage coil. The local isolating function hence has no means for operating the undervoltage coil. Hereto, the local isolating function is only able to operate the circuit breaker i.e. to provide both an electrical disconnect of the circuit breaker 13 and to close the circuit breaker, when circuit breaker 13 has been operated locally by the local isolating function. This is due to the fact, that pressing the first button 21 and/or the second button 23 will not influence the opening coil/closing coil in case the undervoltage coil has set the circuit breaker 13 in its interlocked state, in which the first button and the second button have been disconnected from the opening coil and the closing coil, respectively.

The electrical system 10 may furthermore optionally comprise a time delay device 19 such as a safety relay. The time delay device 19 is configured to be connected between the control circuit 13*a* of the circuit breaker 13 and the supplementary isolating device 1. The time delay device 19 comprises hardware-coded processing circuitry or processing circuitry comprising software, or a combination of both, configured to provide a control signal to the control system which is configured to control the electrical drive system 15 to reduce the current to the motor M, in case the motor M is in operation when the electrical disconnection switch 5 is set in the first position thus providing an electrical disconnect of the circuit breaker 13.

The time delay device 19 may furthermore comprise delay-circuitry configured to provide a delay from the time when the time delay device 19 obtains the first control signal until it operates the opening coil to provide an electrical disconnect of the circuit breaker, and furthermore to operate the undervoltage coil only after the opening coil has been operated, to obtain interlocking of the operation of the circuit breaker 13.

Figure 3:
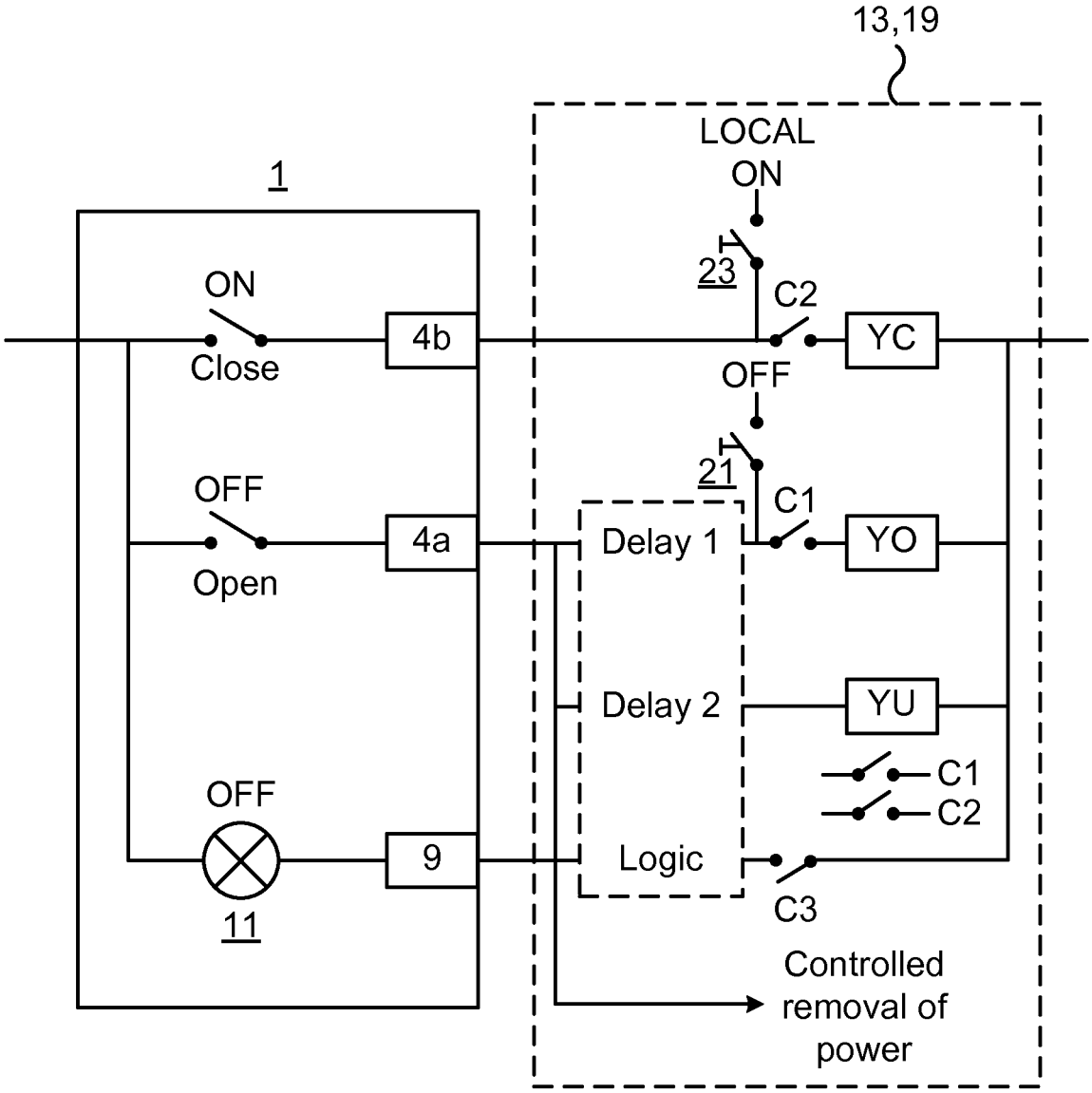
FIG. 3 schematically shows the operation of the electrical system, including the isolating device in FIG. 1.

FIG. 3 shows the general operation of the supplementary isolating device 1 in the electrical system 10. The upper contact shown in the supplementary isolating device 1, when closed, symbolises that the electrical disconnection switch 5 is in the second position. The lower contact shown in the supplementary isolating device 1, when closed, symbolises that the disconnection switch 5 is in the first position.

Thus, when the electrical disconnection switch 5 is set in the first position, the upper contact will be open and the lower contact will be closed. The first control voltage will then be sent to the control circuit 13*a* of the circuit breaker 13, in this case via the time delay device 19. The time delay device 19 will in this case provide a delay before the first control voltage is allowed to operate the opening coil YO of the control circuit 13*a*. The time delay device 19 sends a control signal to the control system in case the motor M is in operation. The delay allows for the electrical drive system 15 to reduce the current to the motor M before providing an electrical disconnect. After some further delay, the time delay device 19 will provide the first control voltage to the undervoltage coil YU, which is then de-energised, whereby the two contacts C1 and C2 are operated, thus disconnecting the first button 21 and the second button 23, respectively, from the opening coil YO and the closing coil YC. This is symbolically illustrated by the two contacts C1 and C2 also being shown adjacent to the undervoltage coil YU. The circuit breaker 13 is thereby set in its interlocked state. The auxiliary contact(s) send(s) an acknowledgement, for status indication, to the supplementary isolating device 1 as the contact C3 is closed also due to the first control voltage. In this situation, it is not possible to operate the circuit breaker 13 by means of the local isolating function. According to one variation, the time delay device 19 may include logic which provides the function that the acknowledgement from the auxiliary contact(s) is only sent to the supplementary isolating device 1 if the opening coil YO has been operated by the first control voltage and the undervoltage coil YU is in a discharged state. Thus, in this case, the indicator 11 will only indicate that the circuit breaker 13 is in the open state if the electrical disconnect has been provided from the supplementary isolating device 1.

When the electrical disconnection switch 5 is set to the second position, the upper contact shown in the supplementary isolating device 1 is set in the closed position and the lower contact is set in the open position. The second control voltage is thus provided to the time delay device 19. The absence of the first control voltage results in that the undervoltage coil YU is fed with a DC voltage that energises the undervoltage coil YU, resulting in that the contacts C1 and C2 close, whereby the second control voltage can operate the closing coil YC. In this manner, the supplementary isolating device 1 duplicates the behaviour of the local isolating function, but also provides protection from operation of the first button 21 and the second button 23 when the circuit breaker 13 is operated by the supplementary isolating device 1.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A supplementary isolating device for remote operation of a circuit breaker with interlocking functionality, wherein the supplementary isolating device comprises:

an electrical disconnection switch manoeuvrable between a mechanically lockable first position and a mechanically lockable second position, which electrical disconnection switch is configured to be connected in the control circuit of a circuit breaker for an electrical drive system, wherein the supplementary isolating device is configured to send a first control voltage to the circuit breaker to provide an electrical disconnect and interlocking the operation of the circuit breaker, when the electrical disconnection switch is in the first position, an electric terminal, configured to be connected to an auxiliary contact of the circuit breaker to obtain an operational status of the circuit breaker, and an indicator configured to indicate the operational status of the circuit breaker.

2. The supplementary isolating device as claimed in claim 1, wherein the supplementary isolating device is configured to send a second control voltage to the circuit breaker to close the circuit breaker when the electrical disconnection switch is in the second position.

3. The supplementary isolating device as claimed in any of claim 2, comprising a first switch terminal configured to be connected to an opening coil and to an undervoltage coil of the control circuit for providing the first control voltage, and a second switch terminal configured to be connected to a closing coil of the control circuit for providing the second control voltage.

4. The supplementary isolating device as claimed in claim 2, wherein the electrical disconnection switch is configured to be locked in the first position and in the second position by means of a padlock.

5. The supplementary isolating device as claimed in claim 2, wherein the indicator is a visual indicator.

6. The supplementary isolating device as claimed in claim 2, comprising a first low voltage electric wire and a second low voltage electric wire each having a length in the order of a plurality of metres, the first electric wire and the second electric wire being configured to be connected between the electrical disconnection switch and the control circuit of the circuit breaker to send the first control voltage and the second control voltage, respectively, from the supplementary isolating device to the control circuit.

7. The supplementary isolating device as claimed in claim 2, comprising a signal cable having a length in the order of a plurality of metres, the signal cable being configured to be connected between the electric terminal and the auxiliary contact to obtain the operational status of the circuit breaker.

8. The supplementary isolating device as claimed in claim 1, wherein the electrical disconnection switch is configured to be locked in the first position and in the second position by means of a padlock.

9. The supplementary isolating device as claimed in claim 8, comprising a first switch terminal configured to be connected to an opening coil and to an undervoltage coil of the control circuit for providing the first control voltage, and a second switch terminal configured to be connected to a closing coil of the control circuit for providing the second control voltage.

10. The supplementary isolating device as claimed in claim 1, wherein the indicator is a visual indicator.

11. The supplementary isolating device as claimed in claim 1, comprising a first low voltage electric wire and a second low voltage electric wire each having a length in the order of a plurality of metres, the first electric wire and the second electric wire being configured to be connected between the electrical disconnection switch and the control circuit of the circuit breaker to send the first control voltage and the second control voltage, respectively, from the supplementary isolating device to the control circuit.

12. The supplementary isolating device as claimed in claim 11, wherein each of the first low voltage electric wire and the second low voltage wire has a length in the order of a plurality of metres.

13. The supplementary isolating device as claimed in claim 1, comprising a signal cable having a length in the order of a plurality of metres, the signal cable being configured to be connected between the electric terminal and the auxiliary contact to obtain the operational status of the circuit breaker.

14. An electrical system for a motor, comprising:

an electrical drive system configured to drive the motor, a circuit breaker with interlocking functionality, wherein the circuit breaker is configured to disconnect the electrical drive system from a power source configured to power the electrical drive system, and a supplementary isolating device configured to operate the circuit breaker from a remote location relative to the circuit breaker and the electrical drive system including:

an electrical disconnection switch manoeuvrable between a mechanically lockable first position and a mechanically lockable second position, which electrical disconnection switch is configured to be connected in the control circuit of a circuit breaker for an electrical drive system, wherein the supplementary isolating device is configured to send a first control voltage to the circuit breaker to provide an electrical disconnect and interlocking the operation of the circuit breaker, when the electrical disconnection switch is in the first position, an electric terminal configured to be connected to an auxiliary contact of the circuit breaker to obtain an operational status of the circuit breaker, and an indicator configured to indicate the operational status of the circuit breaker.

15. The electrical system as claimed in claim 14, wherein the circuit breaker includes a first button, a second button, an opening coil, an undervoltage coil and a closing coil, wherein the first button is configured to operate only the opening coil and the second button is configured to operate only the closing coil.

16. The electrical system as claimed in claim 15, wherein the opening coil is configured to be operated with the first control voltage from the supplementary isolating device to provide an electrical disconnect of the circuit breaker, the closing coil being configured to be operated with the second control voltage from the supplementary isolating device to provide a closing of the circuit breaker, wherein the undervoltage coil is configured to be operated by the first control voltage to disconnect the opening coil from the first button and to disconnect the closing coil from the second button and to be operated by the second control voltage to connect the closing coil to the second button and the opening coil to the first button.

17. The electrical system as claimed in claim 16, comprising a time delay device configured to be connected to the control circuit of the circuit breaker, and configured to be connected to the supplementary isolating device for receiving the first control voltage and the second control voltage and to operate the opening coil and the undervoltage coil and the closing coil, of the control circuit in accordance with the first control voltage and the second control voltage.

18. The electrical system as claimed in claim 17, wherein the time delay device has a delay functionality configured to provide a delay from receiving the first control voltage to operating the opening coil, wherein the time delay device is configured to operate the undervoltage coil after operating the opening coil.

* * * * *